US005097100A

United States Patent [19]

Jackson

[11] Patent Number: 5,097,100

[45] Date of Patent: Mar. 17, 1992

[54] NOBLE METAL PLATED WIRE AND TERMINAL ASSEMBLY, AND METHOD OF MAKING THE SAME

[75] Inventor: Jeffery E. Jackson, Kirkland, Wash.

[73] Assignee: Sundstrand Data Control, Inc., Redmond, Wash.

[21] Appl. No.: 645,958

[22] Filed: Jan. 25, 1991

[51] Int. Cl.[5] ..... H01R 4/02; H01R 43/02

[52] U.S. Cl. ..... 174/94 R; 29/843; 174/126.2; 219/56.22; 228/4.5; 228/179; 439/887

[58] Field of Search ..... 174/94, 126.2; 439/886, 439/887; 29/843, 860; 228/4.5, 179; 219/56.1, 56.21, 56.22

[56] References Cited

U.S. PATENT DOCUMENTS

| | | | |
|---|---|---|---|
| 1,896,613 | 2/1933 | Fowle | 174/126.2 X |
| 2,268,617 | 1/1942 | Pierce | 174/126.2 X |
| 3,190,954 | 6/1965 | Pomerantz | 174/94 R X |
| 3,297,855 | 1/1967 | Bowers | 174/126.2 X |
| 4,001,093 | 4/1977 | Koontz et al. | 204/15 |
| 4,002,778 | 1/1977 | Bellis et al. | 427/98 |
| 4,069,963 | 1/1978 | Prasad | 228/179 |
| 4,171,477 | 10/1979 | Funari | 228/4.5 X |
| 4,238,300 | 12/1980 | Yoshida | 204/46 |
| 4,605,833 | 8/1986 | Lindberg | 219/56.22 |
| 4,739,142 | 4/1988 | Hirota et al. | 219/56.22 |
| 4,776,509 | 10/1988 | Pitts et al. | 228/179 |
| 4,950,866 | 8/1990 | Kojima et al. | 219/56.22 X |

FOREIGN PATENT DOCUMENTS

| | | | |
|---|---|---|---|
| 200954 | 6/1983 | German Democratic Rep. | 219/56.22 |
| 17436 | 1/1989 | Japan | 174/126.2 |

*Primary Examiner*—Morris H. Nimmo

*Attorney, Agent, or Firm*—Neuman, Williams, Anderson & Olson

[57] ABSTRACT

A lightweight, substantially corrosion-proof, conductive wire and terminal assembly (10) comprising a wire (12) laid on and welded to a terminal pad (18) at or near the end (16) of the wire. The wire (12) has an electrically conductive core (24) having a cylindrical surface. The cylindrical surface is substantially completely enveloped in a sheath of noble metal plating (26, 28). The terminal pad (18) has a noble metal surface where it is welded to the cylindrical surface of the wire (12), so the joint (22) formed by the weld is substantially sheathed in a noble metal, and thus is substantially as corrosion-proof as the noble metal sheath (26, 28) and terminal pad (18). The wire (12) is preferably covered with insulation (30) except at its end (16), which may be stripped. This invention has the advantage that the joint (22) does not require a post-plating operation after the wire and terminal pad (18) are welded together, yet the joint (22) is stronger than a joint between dissimilar metals such as copper wire (12) and a gold terminal pad (18) and substantially as corrosion-proof as the plating (26, 28). A method for forming the assembly (10) is also disclosed.

17 Claims, 1 Drawing Sheet

NOBLE METAL PLATED WIRE AND TERMINAL ASSEMBLY, AND METHOD OF MAKING THE SAME

FIELD OF THE INVENTION

The present invention relates generally to electrically conductive wires and terminals which are subject to corrosion in the environment where they are used, and particularly to the wire and terminal assemblies of the fine, lightweight, electromagnetic coils of precision force-sensing instruments. Three examples of such instruments are accelerometers, magnetometers, and inclinometers for vehicle, vessel, and aerospace inertial navigation devices downhole oil well measurement and other uses.

BACKGROUND OF THE INVENTION

Force-sensing instruments are disclosed in U.S. Pat. Nos. 4,932,258 (issued to Norling on June 12, 1990, and not admitted to be prior art); U.S. Pat. No. 4,441,366 (issued to Hanson on Apr. 10, 1984); U.S. Pat. No. 4,399,700 (issued to Hanson on Aug. 23, 1983; and U.S. Pat. No. 4,394,405 (issued to Atherton on July 19, 1983). These patents are owned by Sundstrand Data Control, Inc. The precision electromagnetic wire coils of such instruments must be non-magnetic (i.e. not magnetic or paramagnetic) so they will not be influenced by ambient magnetic fields, such as the internal, permanent magnetic field of an accelerometer, the Earth's magnetic field, or magnetic fields surrounding nearby electrical equipment. The wire used in such coils is extremely fine, for example 44 to 46 gauge AWG (55.9 to 44.4 micron nominal diameter) magnet wire. The wire used to make such coils must have an extremely precise and constant weight, so the coils will have minimal variations in weight and electrical and mechanical characteristics over time, or from coil to coil.

Corrosion of the copper wire of such a coil by the oxygen in air; by wire-drawing and other lubricants; by outgassing of potting compounds, adhesives, and impurities in other parts; and by other environmental factors will significantly change its weight and conductivity during the service life of a device containing it, and thus affect the accuracy of the device. Such corrosion is made worse if the copper wire is exposed to heat and captive moisture, particularly if it is heated and cooled repeatedly. One example of cyclic heating is incorporation of such coils in well measurement tools used in downhole oil well drilling equipment. Downhole temperatures exceeding 150° C. alternating constantly with ambient surface temperature are common in this environment.

When the copper wire of such a coil is heated, it tends to throw off impurities. When it cools, the copper wire takes up any impurities which may be present. Such impurities may accelerate corrosion, particularly in the welded joint between the wire and its terminals, and thus cause the joint to fail. Such corrosion must be minimized.

Conventional corrosion-inhibiting insulation, such as varnish, water glass (sodium silicate solution), or another non-metallic material is not suitable in this environment because the insulation must be stripped from the ends of the wire which are welded to terminal pads. Thus, the welded copper wire is exposed to air at the joint. Even if the ends of the wire are stripped of insulation and then plated with gold or another noble metal, the plating will not adhere to the insulation from which the stripped end extends. Thus, contaminants and corrosion can penetrate to the copper conductor between the point where the insulation ends and the point where the plating begins.

Another problem in the art is the strength of the weld between the end of a copper coil and a gold terminal pad, for example, the gold terminal pads or plating to which the ends of the coils referred to herein are welded. Moderate loads on the coil in the field may break this weld and cause the equipment to fail.

Yet another problem in the art is the need to protect a coil and its joints with terminal pads from corrosion without appreciably changing the weight or mechanical, electrical, or magnetic characteristics of the coil, so the attached mechanical elements do not need to be redesigned for a new coil. For example, wires made of solid noble metal, such as gold, would weigh more and be less conductive for a given cross-section than copper wires. Wires made of nickel would be paramagnetic, which is undesirable.

The present assignee has previously formed a welded joint directly between a gold terminal pad and the usual insulated copper magnet wire of a precision electromagnetic coil. In one technique (which is not admitted to be prior art), the end of the wire to be joined was stripped, and a stripped portion of its cylindrical surface at or near its end was laid on the terminal pad and welded to it. In the finished joint, the stripped end of the wire often protruded from the joint. This joint was made of dissimilar metals, one of which was non-noble, so the joint was subject to galvanic corrosion. The copper wire in and adjacent to the joint was exposed to outgassing from adjacent components, captive air and moisture, and the like, and thus was also prone to chemical corrosion.

The art also teaches that electrical conductors, particularly the conductor patterns on printed and integrated circuits, can be corroded by their environments, even by ordinary air, so they should be plated with a less easily corroded (i.e. more noble) metal. Nickel, gold, and other metals are known to be useful as such coatings. The prior art also teaches that noble metals per se, and particularly gold, are desirable electrical conductors in microcircuit applications in which the total quantity of gold used is small, so its weight and expense are not significant.

U.S. Pat. No. 4,238,300 (Yoshida), column 1, teaches that copper headers and housings for semiconductor diodes, which would be contaminated by copper ions, can be electroplated with gold. At column 4, Yoshida teaches "hard" gold plating bath formulations (containing cobalt or nickel hardening additives) and "soft" gold plating bath formulations which can be used to plate gold.

U.S. Pat. No. 4,001,093, issued to Koontz et al. on Jan. 4, 1977, teaches that precious metals like gold can be plated on localized parts of electrical components, such as connectors and switches. The reference states that surface contact to gold usually has low electrical resistance, and that the small-dimensioned conductor lines of copper printed circuits initially may have acceptable conductivity, but rapidly degrade with time. The reference also states that, by adding small amounts of arsenic, copper, or nickel to gold, the gold can be made quite hard and resistant to abrasion.

U.S. Pat. No. 4,002,778, issued to Bellis et al. on Jan. 11, 1977, teaches that nickel or cobalt can be plated onto the conductor pattern of a printed circuit.

OBJECTS OF THE INVENTION

One object of the invention is a conductive wire and joined terminal assembly which will not appreciably change in weight or mechanical or electrical characteristics during its lifetime.

Another object of the invention is a wire which will resist corrosion, particularly at or near the ends of the wire which are stripped of insulation.

An additional object of the invention is a lightweight, substantially corrosion-proof, conductive wire and joined terminal assembly which does not require post-plating after the assembly is joined.

Other objects of the invention will become apparent from the present description, drawing, and claims.

SUMMARY OF THE INVENTION

One aspect of the present invention is a lightweight, substantially corrosion-proof, conductive wire and terminal assembly. The assembly comprises a wire and a terminal pad welded together. The wire has an electrically conductive core having a cylindrical surface and a first end having an end surface. The cylindrical surface is substantially completely enveloped in a inner sheath of noble metal plating. The end surface of the first end of the wire remains unplaced. Each terminal pad has a noble metal surface where it is welded to the sheathed cylindrical surface of the wire at a point at or near the end of the wire, so the joint formed by the weld is substantially sheathed in a noble metal, and thus is substantially as corrosion-proof as the noble metal sheath of the wire. The joint does not require a post-plating operation after the wire and terminal pad are welded together. Also, because the wire sheath and the noble metal surface can be made of the same material, they can be welded to form a stronger joint than, for example, a copper wire welded to a gold surface. The plated wire and joint also have lower electrical resistance than their unplated counterparts.

Another aspect of the invention is a method for forming a wire and terminal assembly, comprising the steps of plating the cylindrical outer surface of a parent wire with a substantially coextensive inner sheath of a noble metal, optionally insulating the wire with an outer sheath of insulation and providing a stripped end, providing a terminal pad having a noble metal surface, laying the plated cylindrical surface of the wire against the noble metal surface to form a joint, and welding the joint. The stripped end of the wire is defined by an end of the outer sheath of insulation which is recessed from the end of the wire. The stripped portion of the wire defines a plated cylindrical end surface of the wire which is laid down on and joined to the terminal pad.

BRIEF DESCRIPTION OF DRAWING

The Figure is a diagrammatic sectional view of an electromagnetic coil and wire termination according to the present invention. The drawing is not to scale, as the thickness of the plating is exaggerated and the end of the wire and the terminal pad are greatly enlarged for clarity of illustration.

DETAILED DESCRIPTION OF THE INVENTION

Figure 1:
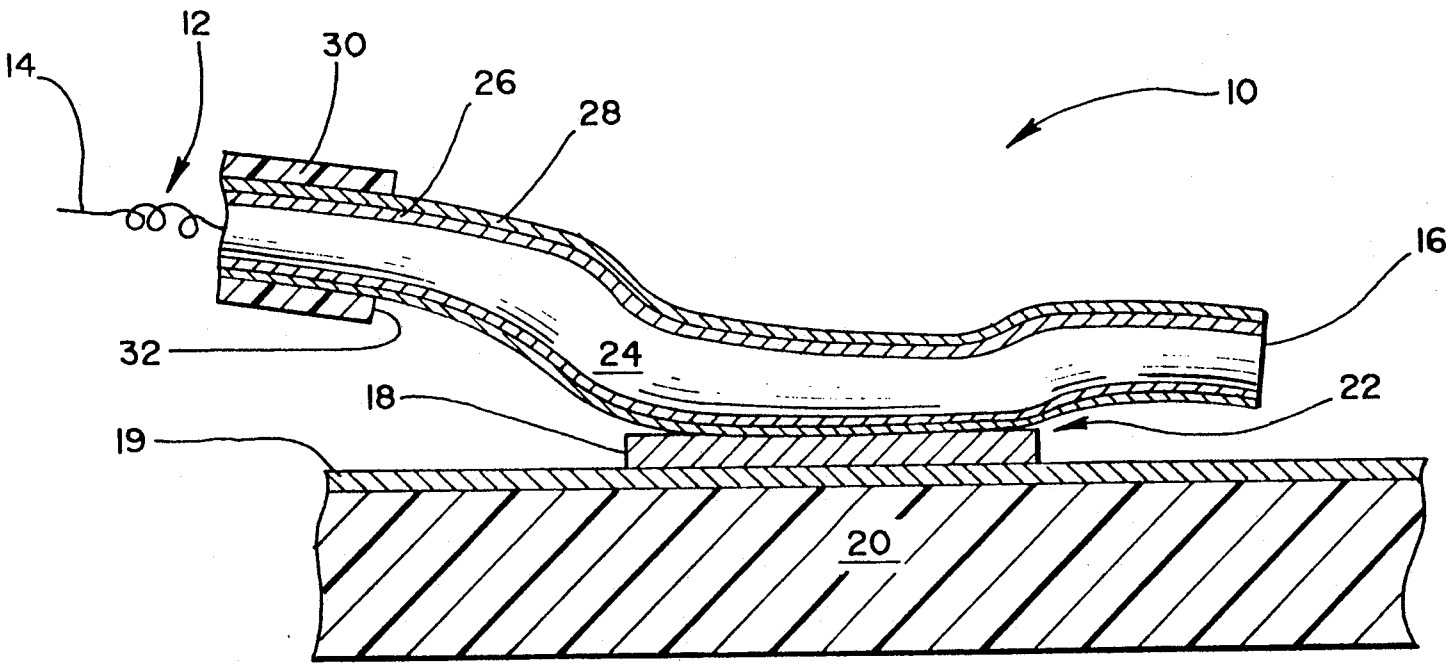

While the invention will be described in connection with one or more preferred embodiments, it will be understood that the invention is not limited to those embodiments. On the contrary, the invention includes all alternatives, modifications, and equivalents as may be included within the spirit and scope of the appended claims.

One aspect of the present invention is a wire termination comprising a wire plated throughout its length with a noble metal and having its cylindrical surface welded to a noble metal terminal pad.

Referring now to the Figure, a wire and terminal assembly 10 illustrating the invention comprises a schematically drawn electromagnetic coil formed of a wire 12 having ends 14 and 16. The portion of the wire 12 near its end 16 preferably has the same diameter as, and is integral with, the rest of the wire 12. In the Figure, however, the end 16 is greatly enlarged to show the details of its plating and its connection to a terminal pad 18 fixed to a vapor-deposited metal (here, gold) layer 19 adhered to a substrate 20. An exemplary substrate 20 is a quartz disc which functions as a mechanical element of a device. The gold layer 19 functions as a capacitor plate. The terminal pad 18 is provided to bolster the layer 19 so it can withstand the rigors of welding. The wire and terminal assembly 10 of the present invention comprises, at a minimum, the end 16, the terminal pad 18, and the welded joint 22 between them.

In this embodiment, the wire 12 is a copper core 24 having a cylindrical surface which is uniformly plated with a substantially coextensive inner layer 26 of gold and a substantially coextensive outer layer 28 of gold. ("Plating" is broadly defined herein to include conventional electrolytic or electroless plating or an analogous metal coating applied in another manner, as by vapor deposition, sputtering, co-drawing, dipping, or the like.) In one embodiment, the inner layer 26 is plated from a soft gold formulation and the outer layer 28 is plated from a hard gold formulation, each as described below. In another embodiment, each layer 26, 28 is plated from a soft gold formulation and is drawn as described below to improve its integrity and hardness.

After it is plated, the wire 12 is insulated with conventional magnet wire insulation 30, such as a polyamide formulation. The wire ends such as 16 are cut and stripped of insulation up to the shoulder 32 after the wire core 24 is plated and insulated. Thus, the plating layers 26 and 28 are cut through and the copper of the core 24 is exposed at the end 16 both before and after the joint 22 is assembled and welded.

In this embodiment, the wire core 24 can be copper, silver, aluminum, or any other non-magnetic, conductive material having potential to corrode or accept impurities in the environment of use. The layers 26 and 28, the terminal pad 18, and the layer 19 can be made of any essentially non-magnetic noble metal which will not corrode in the environment of the joint 22. Noble metals specifically contemplated herein include those selected from the group consisting of gold, ruthenium, rhodium, palladium, osmium, iridium, platinum, and combinations thereof. The group consisting of gold, palladium, and their alloys is particularly contemplated herein. A one-layer or plural-layer plating of noble metal is contemplated.

The terminal pad 18 and layer 19 are preferably made of essentially the same noble metal as the noble metal of the layer 26 and (if present) 28. The terminal pad 18 shown in the Figure could also be plated with a noble metal, instead of being the illustrated solid pad of noble metal.

The Figure shows a portion of the layer 28 spaced from its end 16 laid against the surface of the terminal pad 18 and a sharp interface between those elements. The Figure thus shows the construction of the joint when it is assembled and before it is welded.

In one embodiment, parallel gap resistance welding is used to join the elements of the joint 22. Ultrasonic welding is also contemplated herein. The joint is welded rather than soldered to avoid adding an indeterminate amount of another metal to the joint.

The construction of the joint changes as a result of the welding process. The sharp interfaces between the noble metal layers 26 and 28 (if both are present) and the interfaces of the same layers with the terminal pad 18 are essentially eliminated in the vicinity of the joint 22, and these elements are merged to form a continuous coating enveloping the core 24.

The resulting exposed copper face of the end 16 may corrode when the core 24 is copper. However, in this embodiment the corrosion only proceeds roughly three times as far axially as the diameter of the core 24. Further corrosion is suppressed because the gold plating layers 26 and 28 retain their integrity and a plug of corrosion products lodged within the plating obstructs the access of corrosive materials to the uncorroded portion of the core 24 via the exposed copper face of the end 16 of the plated wire. The degree of corrosion at the end 16 is so slight that it does not materially affect the mechanical, inertial, or electrical characteristics of the coil or the integrity of the welded joint 22.

A benefit of this joint 22 is that its exposed surfaces are substantially completely clad in plating without the necessity of plating the joint 22 after it is formed, or the end 16 after it is cut.

The wire 12 can be wire of large or small diameter which is drawn or otherwise formed of any electrically conductive material, but preferably is copper or a copper alloy having a high electrical conductivity. The preferred wire is a finely drawn copper wire of the type conventionally called magnet wire and used for winding electromagnetic coils. An example is wire having a gauge of from about 44 to about 46 AWG, which corresponds to a diameter of from about 44.4 to 55.9 microns. This diameter is not regarded as critical, although the invention is particularly advantageous for use with a fine copper wire conductor.

The coextensive plating on the conductor distinguishes this invention from the prior practice of plating only the ends of conductors which are to be joined. The present inventor has found that such partial plating creates a corrosion problem because two different metals are exposed to environmental conditions at the point where the plating ends. This point is found below the shoulder 32, and thus at this point the adjacent plating and core are exposed to air and other corrosive materials.

Electrolysis is a preferred method for applying the gold plating. Electrolytic plating can be controlled precisely by regulating the bath composition and conditions, current density, exposure time, and other factors closely. An extremely thin, uniform, continuous plating of gold can be applied as a result. While the wire may be cut before it is plated, so the cut ends are plated as well, the inventor contemplates that the wire may be plated then cut, and the ends of the wire can be welded to terminal pads as described herein without covering the exposed ends of the wire with gold. If the wire is plated before it is cut, the wire for an individual coil does not need to be handled as a separate unit. This facilitates an efficient, essentially continuous plating operation. The plating operation can be performed on wire which has already been drawn and spooled, or the drawing and plating operations can be integrated.

For the present invention, one important object is to plate the conductor with the thinnest layer of gold which will protect the copper from corrosion. A thicker layer may protect the conductor as well as or better than a thin layer, but will add weight and cost to the conductor. A thicker layer may also have a greater capacity to accept copper ions from the conductor than a thinner layer, therefore absorbing enough copper over a long period of time to change the conductivity or other electrical characteristics of the coil. Any such changes in the coil are undesirable.

Each plated gold layer can be from about 0.00001 ($1\times10^{-5}$) to about 0.0001 ($1\times10^{-4}$) inch (from about 0.25 to about 2.5 microns) thick, preferably from about $2\times10^{-5}$ to about $5\times10^{-5}$ inch (from about 0.5 to about 1.3 microns) thick, most preferably from about 2.0 to about $2.5\times10$ inch (from about 0.5 to about 0.6 microns) thick. The inner and outer layers 26 and 28 may be equally thick, or may have different thicknesses. The combination of these two platings, or a single layer of noble metal plating, may be from about $2\times10^{-5}$ to about $2\times10^{-4}$ inch (from about 0.5 to about 5.0 microns) thick. Specifically, the combination of a soft gold inner layer about $2.5\times10^{-5}$ inch (about 0.6 microns) thick and a substantially equally thick hard or soft gold outer layer are expressly contemplated.

The soft gold used herein for plating can be any conventional or specially formulated soft gold formulation. For example, the products of plating with the baths defined in column 4, examples 1 or 2 of U.S. Pat. No. 4,238,300 (cited above) and the soft gold plating baths of the literature, such as F. H. Reid and W. Goldie, *Gold Plating Technology* (Electochemical Publications Ltd., 1974), are contemplated for use herein.

The hard gold optionally used herein for plating can be any conventional or specially formulated hard gold formulation. For example, the products of plating with the baths defined in column 4, examples 3 or 4 of U.S. Pat. No. 4,238,300 and the products of plating with the hard gold plating baths of the literature, such as F. H. Reid and W. Goldie, *Gold Plating Technology*, supra, are contemplated for use herein. (The Reid publication and the cited portions of U.S. Pat. No. 4,238,300 are hereby incorporated by reference herein for their illustrations of soft and hard gold plating baths.) Generally speaking, hard gold bath formulations are distinguished by the presence of hardening alloy formers, such as cobalt, copper, arsenic, or nickel.

Hard gold formulations which form plating containing substantial proportions of nickel and cobalt are preferably avoided if the plating is paramagnetic. However, hard gold formulations which contain a small proportion, such as about 0.005%, of cobalt form plating which is not paramagnetic, and consequently which is contemplated herein. The amount of any copper used in the gold formulation should not be sufficient to render the plating subject to corrosion. The hard gold plating can be applied in the same manner as described above for the soft gold plating, and is applied directly on top of the soft gold plating in one embodiment of the present invention.

Alternatively, a soft gold plating may be applied by any means, then hardened by doping with arsenic or other materials to form a hard gold layer. If the hardening is concentrated at the outer surface of a single, originally soft gold plating, the equivalent of a soft gold inner plating and a hard gold outer plating may be obtained. In another alternative, soft gold plating may be applied, then mechanically hardened. For example, after a layer of gold is plated, and preferably after each layer of gold is plated, the plated wire can be cold drawn. The thickness of the gold after cold drawing can be as described previously. Drawing is believed to densify and harden the gold and to smear it sufficiently to fill pin holes and correct other irregularities. Following the drawing step, the gold is believed to be harder and more corrosion-resistant than an equally thick layer of undrawn, plated gold. After drawing, the gold is also believed to be more resistant to copper migration.

The process of finishing a wire to insulate it and protect it from corrosion is carried out as previously explained. The wire is plated throughout its length, and is insulated after it is plated. The insulation is stripped from or not applied to the ends of the wire, so the plating extends under the insulation. This is a reversal of the conventional insulating and selective plating steps. This reversal provides the unexpected result of improved resistance of the wire to corrosion, particularly at its ends. The plated wire 12 also has a lower electrical resistance than unplated insulated wire.

Working Example

A 46 AWG (44.4 micron diameter) copper magnet wire was electrolytically plated with an inner layer of soft gold about $2.5\times10^{-5}$ inch (about 0.6 microns) thick, which in turn was plated with a hard gold plating of about the same thickness. The wire was plated with gold like the wire in the Figure.

A second, unplated 46 AWG copper magnet wire was cut in the same manner to form 20 short, equal lengths.

A layer 19 of soft gold was vapor-deposited on a flat surface of a quartz disc 20. Then one of the major faces of a solid soft gold terminal pad 18, here an elongated ribbon having a thickness of 2 microns and a width of 4 microns, was welded to the vapor-deposited layer 19, leaving the other major face of the terminal pad 18 exposed. Finally, both ends of each short length of each type of wire were laid on and welded to the exposed major face of the terminal pad in the manner illustrated in the Figure, using parallel gap welding. (In parallel gap welding, two electrodes separated by a gap are used. One of the electrodes contacts one of the two pieces to be welded and the other electrode contacts the other piece.) The welding equipment used to join the ends of the loops to the terminal pad was a Hughes Tool Co. Model MCW 550 resistance welder set at a work clamping force of 475 units, a potential of 0.45 volt, and a 0.375 second welding duration.

After welding, each short length of wire formed a loop shaped like the upper case Greek letter omega, with each of its feet welded to the terminal pad. All the loops of both types were welded to a single terminal pad.

The initial strength of the welds of each type was determined by pulling the centers of several of the loops of each type until one of the welds failed and the loop opened. The average pull strength at failure of the plated wires was 40 grams (plus or minus 3 grams), and of the unplated wires was 30 grams (plus or minus 5 grams).

The quartz disc was placed flat on the bottom of an upright open, stainless-steel can having a volume of 0.4 cubic inches (about 6.5 cc). The loops and terminal pad mounted on the disc faced the mouth of the can. About 0.1 gram (plus or minus 5%) of a 52–60% (weight of solute per weight of solution) aqueous solution of ammonium sulfide was absorbed in one applicator tip of a cotton swab, which was broken from the swab and placed in the can in contact with the wire loops. (Ammonium sulfide was chosen because it corrodes copper readily and because it simulates the action of occluded sulfur compounds in the steel of an instrument. This is an accelerated test, carried out under more stringent conditions than the ordinary environment of the weld in a precision instrument.)

The mouth of the can was covered with aluminum foil. The foil was manually conformed to the outer wall of the can to seal in the contents. The sealed can was placed in a 200 degree C. oven for 24 hours, then it was removed from the oven, opened, the quartz disc was removed, and the loops and terminal pad were examined.

The plated loops and their welded joints with the terminal pad were not visibly affected by exposure to this test. The pull strength of additional plated loops was measured, and was not significantly different than the pull strengths measured at the beginning of the test, despite the lack of plating on the cut ends of the wires. The unplated wires were almost completely dissolved, leaving pools of black oxide residue on the terminal pad 18. The pull strength of the unplated wires could not be measured because of their state of decay.

To further challenge the gold-plated loops, the quartz disc was returned to the can, the ammonium sulfide-soaked applicator tip was reinserted, and the can was resealed with aluminum foil and placed in a temperature cycling oven for 24 hours. The oven alternately heated the sample to 203 degrees C. for two 20 hours and cooled the sample to −23 degrees C. for two hours. Again, the appearance and pull strength of the plated loops were not affected significantly, while the bare wires were further dissolved and their pull strength again could not be measured.

What is claimed is:

1. A lightweight, substantially corrosion-proof, conductive wire and terminal assembly comprising:

A. an electrically conductive, non-noble metal wire core having an elongated, generally cylindrical outer surface and a first end defining an end surface;

B. an inner sheath of noble metal plating on said core completely covering the cylindrical outer surface of said core, said plating having an end substantially registered axially with the end surface of said core;

C. an outer sheath of non-conductive insulation on said inner sheath, said outer sheath having an end which is recessed axially along said inner sheath from the ends of said inner sheath and core, whereby the ends of said inner sheath and core protrude from the end of said outer sheath to define a noble metal sheathed cylindrical stripped portion; and D. a terminal pad having a noble metal surface which is joined to said inner sheath along an axial line at said cylindrical stripped portion by a weld to form a joint.

2. The assembly of claim 1, wherein the diameter of said wire core is from about 44 to about 56 microns.

3. The assembly of claim 1, wherein said inner sheath is from about 0.00001 to about 0.0001 inch (from about 0.25 to about 2.5 microns) thick.

4. The assembly of claim 1, wherein said inner sheath is about 0.000050 inches (about 1.2 microns) thick.

5. The assembly of claim 1, wherein said noble metal is selected from the group consisting of gold, ruthenium, rhodium, palladium, osmium, iridium, platinum, and combinations thereof.

6. The assembly of claim 1, wherein said noble metal is selected from the group consisting of gold, palladium, and combinations thereof.

7. The assembly of claim 1, wherein said noble metal sheath is gold.

8. The assembly of claim 1, wherein said noble metal sheath is palladium.

9. The assembly of claim 1 wherein said noble metal sheath and said noble metal surface are made of substantially identical noble metals.

10. The wire and terminal assembly of claim 1, wherein the noble metal surface of said terminal pad is joined to said inner sheath only at a portion of said cylindrical stripped portion spaced axially inwardly from the end of said inner sheath.

11. The wire and terminal assembly of claim 10, wherein the noble metal surface of said terminal pad is joined to said inner sheath only at a portion of said cylindrical stripped portion spaced axially outwardly from the end of said outer sheath.

12. A method for forming a substantially corrosion-proof wire and terminal assembly, comprising the steps of providing a parent wire made of non-noble metal and having an elongated cylindrical surface; plating the cylindrical surface of said parent wire with a substantially coextensive sheath of a noble metal; insulating said parent wire with a sheath of insulation after said plating step; severing said parent wire to form a severed first end, stripping said insulation from said wire along an end portion of said cylindrical surface adjacent to said first end; providing a terminal pad having a noble metal surface; laying said wire with the stripped portion of its cylindrical surface against said noble metal surface to form a joint, and welding said joint, wherein said non-noble metal wire remains unplated and uninsulated at said severed first end.

13. The method of claim 12, further comprising the step, following said plating step, of drawing said wire, thereby reducing the outside diameter of said sheath.

14. The method of claim 13, wherein said plating and drawing steps are repeated following said drawing step.

15. A lightweight, substantially corrosion-proof, conductive wire and terminal assembly comprising:

A. an electrically conductive, elongated, non-noble metal, wire core having a generally cylindrical outer surface and an end surface;

B. an inner sheath of noble metal plating on said core, said plating having an end located axially substantially at the end of said core, thereby leaving the end surface of said core unplated; and C. a terminal pad having a noble metal surface which is joined to the cylindrical surface of said sheath by a weld to form a joined in which the end of said core remains uncovered by said terminal pad.

16. The wire and terminal assembly of claim 15, wherein the noble metal surface of said terminal pad is joined to said inner sheath only at a portion of said cylindrical outer surface spaced axially inwardly from the end of said inner sheath.

17. The wire and terminal assembly of claim 15, wherein said inner sheath and core are formed by providing a non-noble metal parent wire, plating said parent wire with a noble metal, and severing a portion of said plated parent wire comprising said inner sheath and said core from the remainder of said parent wire, thereby exposing the end of said core to ambient conditions.

* * * * *